US005398799A

United States Patent [19]

Ranon et al.

[11] Patent Number: 5,398,799

[45] Date of Patent: Mar. 21, 1995

[54] METHOD AND APPARATUS FOR CONVERTING SINGLE PRICE VENDING MACHINES TO MULTIPLE PRICE VENDING MACHINES

[75] Inventors: Uri Ranon, Irvine; Leo G. Pardo, Laguna Niguel, both of Calif.

[73] Assignee: Maxtrol Corp., Santa Ana, Calif.

[21] Appl. No.: 72,323

[22] Filed: Jun. 3, 1993

[51] Int. Cl.[6] ..... G07F 5/10

[52] U.S. Cl. ..... 194/216; 221/125

[58] Field of Search ..... 194/216, 217, 218; 221/14, 125, 6

[56] References Cited

U.S. PATENT DOCUMENTS

| | | | |
|---|---|---|---|
| 3,894,220 | 7/1975 | Levasseur | 194/218 X |
| 4,008,792 | 2/1977 | Levasseur et al. | 194/218 |
| 4,044,877 | 8/1977 | Burton | 221/125 X |

*Primary Examiner*—F. J. Bartuska
*Attorney, Agent, or Firm*—Leonard Tachner

[57] ABSTRACT

A method and apparatus for carrying out the conversion of purely electromechanical can and bottle vending machines to microprocessor controlled can and bottle vending machines. The present invention provides a method and apparatus for carrying out such a conversion at the site of the vending machine in a relatively short amount of time, without requiring any special tools and without requiring any changes to the existing wire harness of the electromechanical machine. The method of the present invention comprises the steps of removing the "smart coin" acceptor and credit relay from the existing vending machine and installing a "dumb coin" acceptor and microcontroller in their place, then disconnecting the harness connectors which normally provide connection between the motor select switches and the motor start switches, as well as the connections between the motor start switches and the credit relay and between the "sold out" switches and the credit relay and interposing a series of sensing modules therebetween, each of which is connected to the microprocessor controller. The sensing circuits provide circuit compatability between 110 Volt AC motor circuits and low voltage DC logic circuits, without requiring re-wiring in the existing motor and switch harnesses.

12 Claims, 9 Drawing Sheets

METHOD AND APPARATUS FOR CONVERTING SINGLE PRICE VENDING MACHINES TO MULTIPLE PRICE VENDING MACHINES

BACKGROUND OF THE INVENTION

1. Field Of The Invention

The present invention relates generally to vending machines of the type used to automatically vend a can or bottle usually containing a liquid such as a soft drink and more specifically to converting such vending machines in the field so that they may vend differently priced cans and bottles as well as adding cash and product accounting information features.

2. Prior Art

Can and bottle vending machines are an important part of the soft drink industry. They are found in virtually every location where people are likely to purchase a can or bottle of soft drink at any time of day or night, where there is some form of public access and generally where there is no other convenient means for purchasing a soft drink. Thus, by way of example, one may find such dispensing machines on most or all floors of every major hotel, in places of recreational activities such as bowling alleys and movie theaters, in places of employment and in high traffic, publically accessible locations such as airports, train stations, bus stations and the like. Historically, such vending machines have been electromechanical devices which use relays, controlling single turn motors, all interconnected by hard wired logic to dispense a single can or bottle upon acceptance of a set amount in currency. In all such electromechanical vending machines, a coin acceptor enables the machine to vend. The vast majority of coin acceptors for electromechanical vending machines are of the single price type, meaning that all products in the machine carry the same price. The coin acceptor is set to that vending price and controls the acceptance and rejection of coins, as well as providing change or turning on an exact change only light when no change is available. Unfortunately, such single price electromechanical can and bottle vending machines, while satisfactory for the intended purpose, suffer the distinct disadvantage of single price operation. Single price operation means that the owner of the vending machine must provide only products having essentially the same value, such as by way of example, different flavors of the same soft drink. Many vending machine companies find it highly desirable to be able to offer a variety of different products having different values and thus require the sale be made at different prices depending upon such value. A vending machine owner may prefer to offer a variety of different products, such as for example in addition to soft drinks, fruit juices, mineral water and specialty refreshments such as gatorade. Can vending machines could also readily dispense totally different products such as tennis balls and the like, where overall package shape is similar to a soft drink can, for example. In each such case where a variety of different value products could be made available to the purchaser at a vending machine, the price for one such product may for example, be 50 cents, while the price for another may be a dollar or more. Unfortunately, the purely electromechanical machines of the past are generally incapable of providing such a multiprice capability which would enable the vending machine owner to offer a variety of products of different value and price. As used herein, the term "multiprice", means that each selector switch can be assigned a price which can be set independently of the price assigned to the other selector switches.

With the advent of microprocessors and microcontrollers, vending machine manufacturers have recently begun providing far more sophisticated vending machines which are capable of providing such multiprice options to the purchaser. However, after virtually decades of prolific distribution of less sophisticated, purely electromechanical machines, there are millions of such machines out in the field which do not provide such multiprice capability. The cost of replacing purely electromechanical machines with new microprocessor controlled machines would be prohibitive. Also significant is the effect that such mass replacement would have on the environment. The huge amount of scrap metal, wire and plastic and the like that would result from the mass substitution of new electronically controlled machines for the previously used electromechanical machines, would be a major detriment to the environment. Even if one were merely to remove all of the interior components of existing machines and replace them with electronically controlled components while using the exteriors, the complexity of such an operation would require that each such machine be brought back to the factory so that the extensive re-working of the interior can be carried out where the tools and labor required for such an operation are available. Thus, such a major operation would also incur significant cost to the owners of vending machines in regard to both the expense of replacing the interior components, as well as to the major cost of removing all of the old machines from the field and shipping them back to the factory and then shipping the converted machines back to the dispensing locations.

The only efficient method for converting single priced can and bottle vending machines to multipriced and accounting capabilities, would be to provide an apparatus and method which permitted such a conversion to be carried out in the field, at the site of the vending machine and in a manner which permitted one man to carry out such an operation in a relatively short period of time without requiring any extraordinary skill or special tools. Thus for example, providing a method and apparatus which would permit such a conversion to be accomplished in the field in approximately thirty minutes or less, with little or no impact on the existing wiring already found in the purely electromechancial machines, would certainly reduce the relative cost and time required to make such a conversion and thus make it feasible for the owners of single priced electromechanical vending machines to update their machines to provide multipriced capability. Furthermore, while providing multipriced capability is certainly the most important advantage of microprocessor control of vending machines, there are other significant advantages which also make such a conversion highly desirable.

The highly sophisticated control, sensing, storage and display capabilities afforded by microprocessor control can also provide other features besides multipricing. Such features include accounting features which permit the vending machine owner to keep accurate track of the total cash received by the machine, as well as the total cash for each different type of product, as well as the number of different products selected by a purchaser, even after the product has been sold out. Other features can significantly reduce the vending machine owners' likelihood of losing money to theft, as well as easing their reporting requirements for income tax and sales tax purposes and also by providing an automatic survey of purchaser preferences with respect to the products being sold. Furthermore, a microprocessor control capability can also generate unique displays which provide purchasers with credit and other messages in operating the machine or of an advertising type which may, for example, be used to influence buying habits, such as by suggesting the desirability of buying the more expensive product available at the vending machine. Furthermore, the microprocessor control capabilities provide more convenient operation for changing the prices of products being offered by the vending machine, such as when costs rise or more valuable products are substituted or when reducing prices, such as when less valuable products are being offered. Furthermore, microprocessor control capability provides more convenient means for testing the operation of the vending machine during periodic maintenance.

All of these features make it highly desirable to be able to convert from a purely electromechanical machine to a microprocessor-controlled machine, but unless such conversion can be carried out in the field in a relatively small period of time, without requiring any special tools or equipment, and without requiring any form of significant re-wiring of the existing machine, all such new capability would essentially be denied because of the prohibitive cost for carrying out conversion using the alternatives discussed above.

SUMMARY OF THE INVENTION

The present invention comprises a method and apparatus for carrying out the aforementioned conversion of purely electromechanical can and bottle vending machines to microprocessor or microcontroller-controlled can and vending machines. More importantly, the present invention provides a method and apparatus for carrying out the aforementioned conversion in the field in a relatively short amount of time, without requiring any special tools and without requiring any changes to the exiting harness of the electromechanical machine. In carrying out the method of the present invention, the "smart coin" mechanism is removed and credit relay associated with existing electromechanical machines is removed or disconnected and replaced by a "dumb coin" mechanism and an electronic controller. The differences between a "smart coin" mechanism and a "dumb coin" mechanism will be explained hereinafter in more detail.

The method of the present invention comprises the steps of 1) removing the "smart coin" acceptor and disconnecting or removing the credit relay from the vending machine; 2) installing a "dumb coin" acceptor and microcontroller in their place; 3) disconnecting the harness connectors which normally provide connection between the motor select switches from the motor start switches as well as the connections between the motor start switches and the credit relay and between the sold out switches and the credit relay. Connections between the motor run switches and the coin acceptor are also normally opened when the harness connectors are disconnected from one another. In most cases, all of the aforementioned disconnections are accomplished at one or more connectors; and 4) connecting the previously mentioned switches to the microcontroller by connecting existing harness connectors to the microcontrollers and replacing or disabling the existing "use exact change" display and installing a multi-element microcontroller controlled display.

The novel apparatus of the present invention resides in the microcontroller and its interface with the existing harness, as well as in unique sensing circuits which, among other capabilities, also permit circuit comparability between 110 Volt AC motor circuits and low voltage DC logic circuits without requiring re-wiring in the existing motor and switch harness. A further significant and highly advantageous feature of the apparatus of the present invention is found in the use of low current sensing which uses current too low to operate the dispensing motors but of sufficient magnitude to sense switch closures in the motor circuit. This feature is particularly unique because it permits select switch depression sensing before currency is inserted; a significant advantage in a converted electromechanical vending machine. Another significant feature in the present invention is the use of motor bypass resistors which permit sensing even when a motor is disconnected such as when there is a corresponding "SOLD OUT" condition. Thus the present invention provides substantially all of the features of a new, fully electronic machine, but without replacing the "old" electromechanical machine and without replacing the old machine's wire harness.

OBJECTS OF THE INVENTION

It is therefore a principal object of the present invention to provide a method and apparatus for field converting electromechanical can and bottle, single-price vending machines to microprocessor-controlled multipriced vending operation.

It is an additional object of the present invention to provide a method and apparatus for converting single-price can and bottle vending machines to multipriced, computer-controlled operation without requiring re-wiring of the wire harness associated with switch and motor operation of the electromechanical machine.

It is still an additional object of the present invention to provide a method and apparatus for efficient and low cost "at-site" conversion of single-price vending machines to multipriced vending machines without requiring special tools or other equipment and without requiring that the machines be shipped to and from a factory location.

It is still an additional object of the present invention to provide an apparatus for integrating a low voltage DC micro-control sensing and control capability into a 110 Volt AC electro-mechanical vending machine without any significant rewiring of the existing motor and switch circuits.

It is still an additional object of the present invention to add a microprocessor control function to existing electromechanical can and bottle vending machines and to provide a low current select switch sensing feature which permits sensing depression of a select switch even when no currency has been deposited into the coin acceptor.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

In order to more fully facilitate a description of the present invention, reference will first be made to FIGS. 1 through 6 for a description of the operation of a typical single price electromechanical can and bottle vending machine. Accordingly, referring now first to FIG. 1, it will be seen that a typical can vending machine of the prior art comprises a plurality of columns or stacks that are filled with cans or bottles. Each column has a motor associated with it and a gear reducer. Typically, the motor is of the 110 Volt AC shaded pole type. A reduced speed shaft is attached to a device that supports the cans and allows a can to be dropped out of the column after a suitable rotation of the shaft and into an accessible aperture through which the purchaser may reach and collect the can. The end of the shaft has a cam attached to it with two switches riding on it. These two switches are the "motor start switch" and the "motor run switch". The number of notches in the can is equal to the number of cans or bottles that can be vended in one full rotation of the shaft. For clarity, in FIG. 1, we show only one notch in the can. The motors and their attendant switches are in the main enclosure of the vending machine. In addition, there is a "sold out switch" for each column which is located near the bottom of the column. The "sold out switch" is activated by a lever that is kept in one position, as long as there are cans in the column and snaps into a second position when the last can is dropped.

Figure 1:
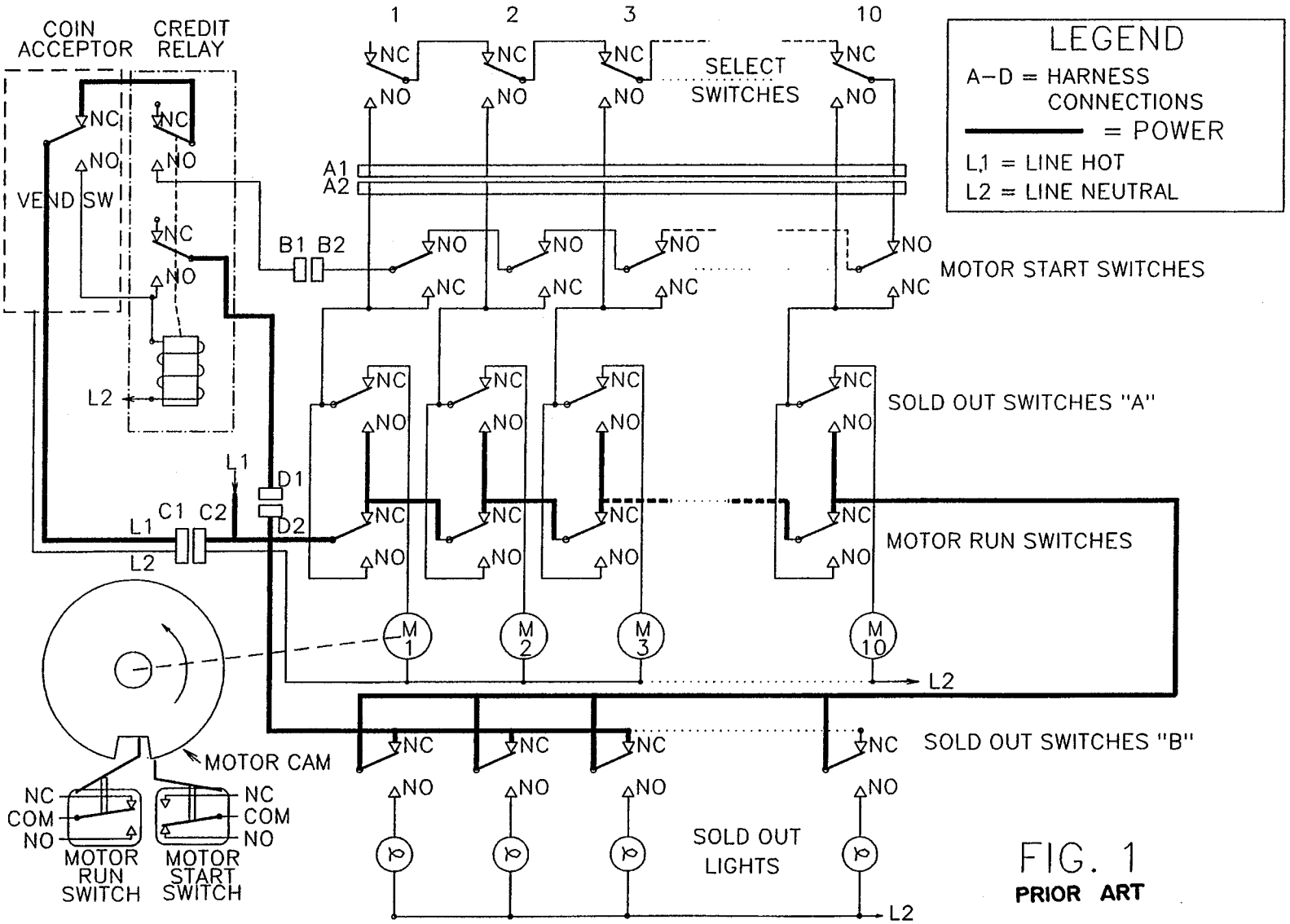
FIG. 1 PRIOR ART
FIGS. 1 through 6 are prior art schematic diagrams of a typical motor and switch circuit of an electromechanical can or bottle vending machine illustrating in sequence, the operation thereof.
Figure 2:
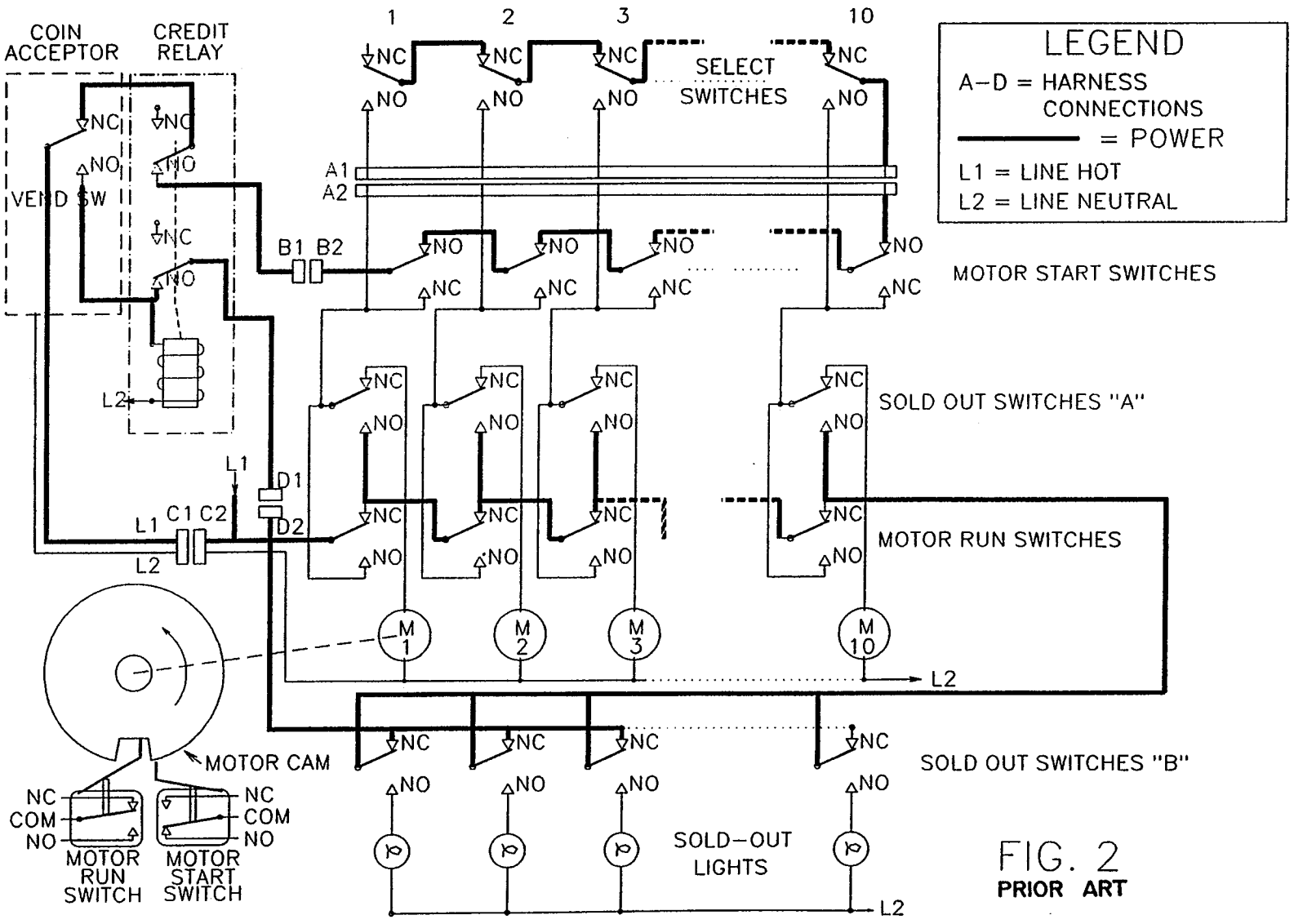
FIG. 2 PRIOR ART

Because the coin acceptor, selector buttons and "sold out" lights are located on the inside of the front door of the vending machine, harness cables are used to interconnect the door to the inner cabinet. The inner cabinet harnesses are always brought out to the door, outside of the refrigerated interior, where they plug into the door harnesses with matching connectors. In FIG. 1, there is shown harness connections A–D for descriptive purposes only. In machines from different manufacturers, or in different models, wires may be grouped differently. FIG. 1 shows the idle condition of the vending machine, that is where no money has yet been deposited for vending. In this mode, no power is applied to the select switches or motor start switches. When the coin acceptor receives sufficient money to initialize a vend operation, the coin acceptor momentarily closes the vend switch. This momentary switching action causes the credit relay to be turned on and latched as shown in FIG. 2. Thus, the only difference between FIGS. 1 and 2 is that the credit relay is activated and latched and as a result, power is now applied to the motor start switches and the select switches and the vending machine is in a condition in which it is waiting for the customer to make a selection.

Figure 3:
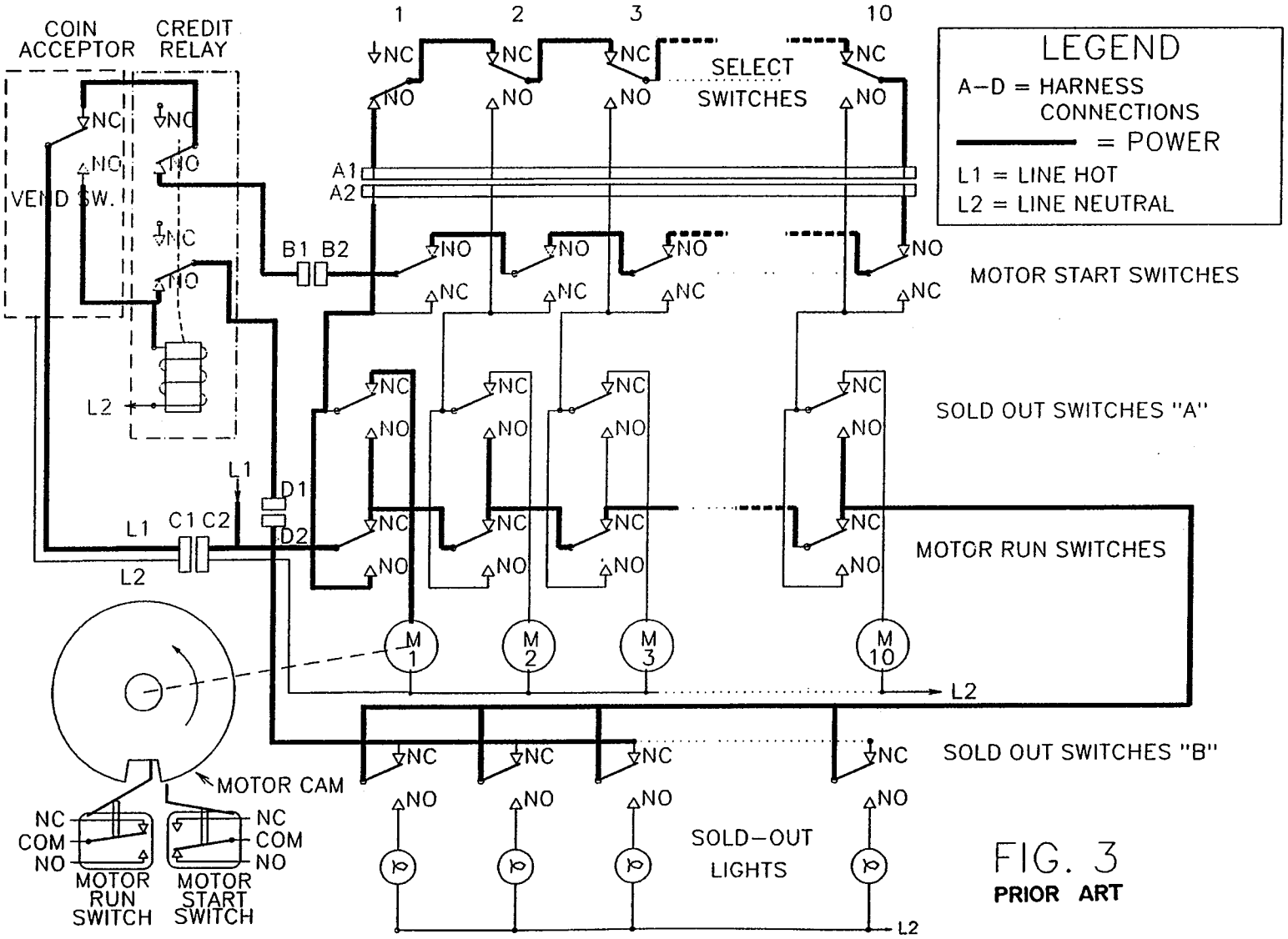
FIG. 3 PRIOR ART
Figure 4:
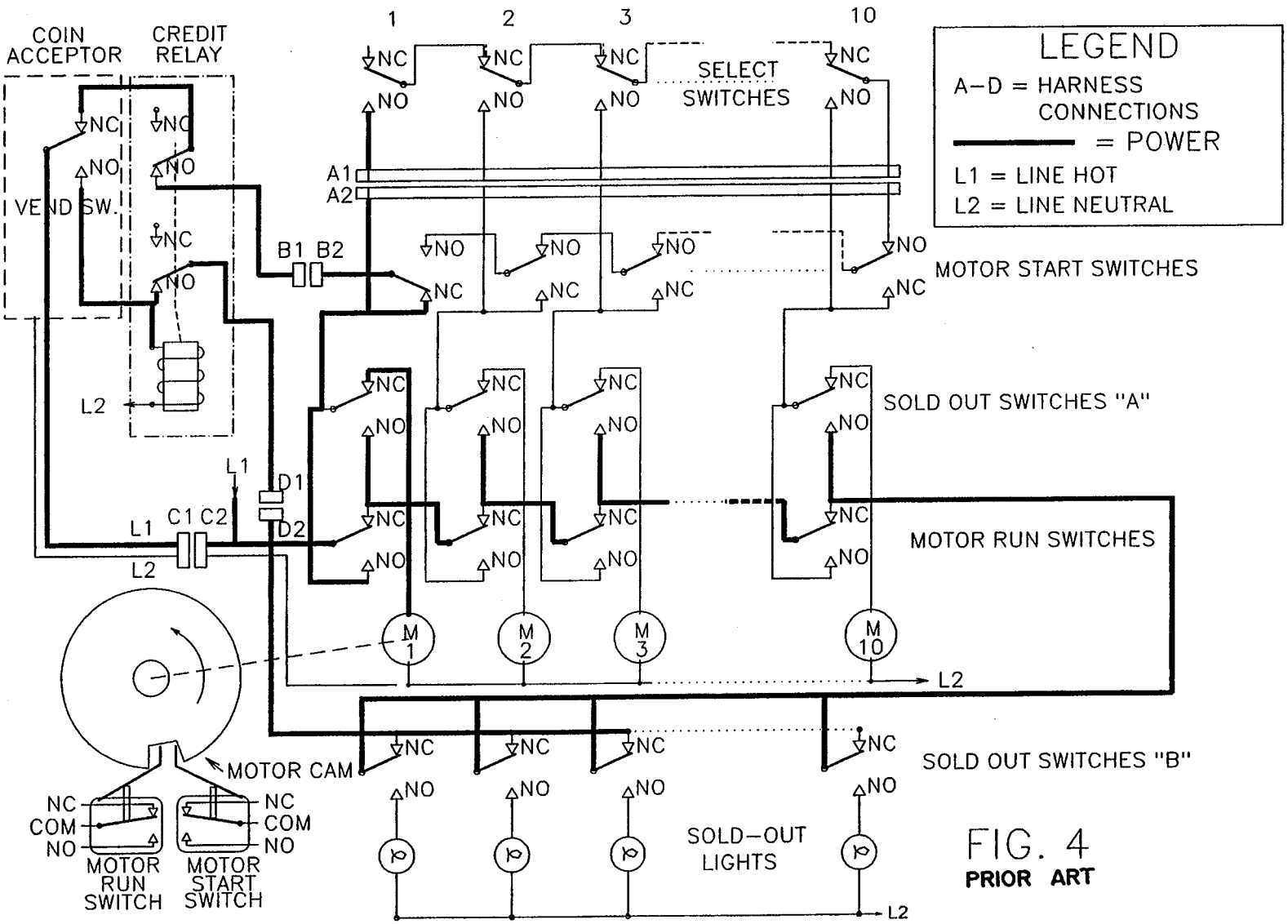
FIG. 4 PRIOR ART
Figure 5:
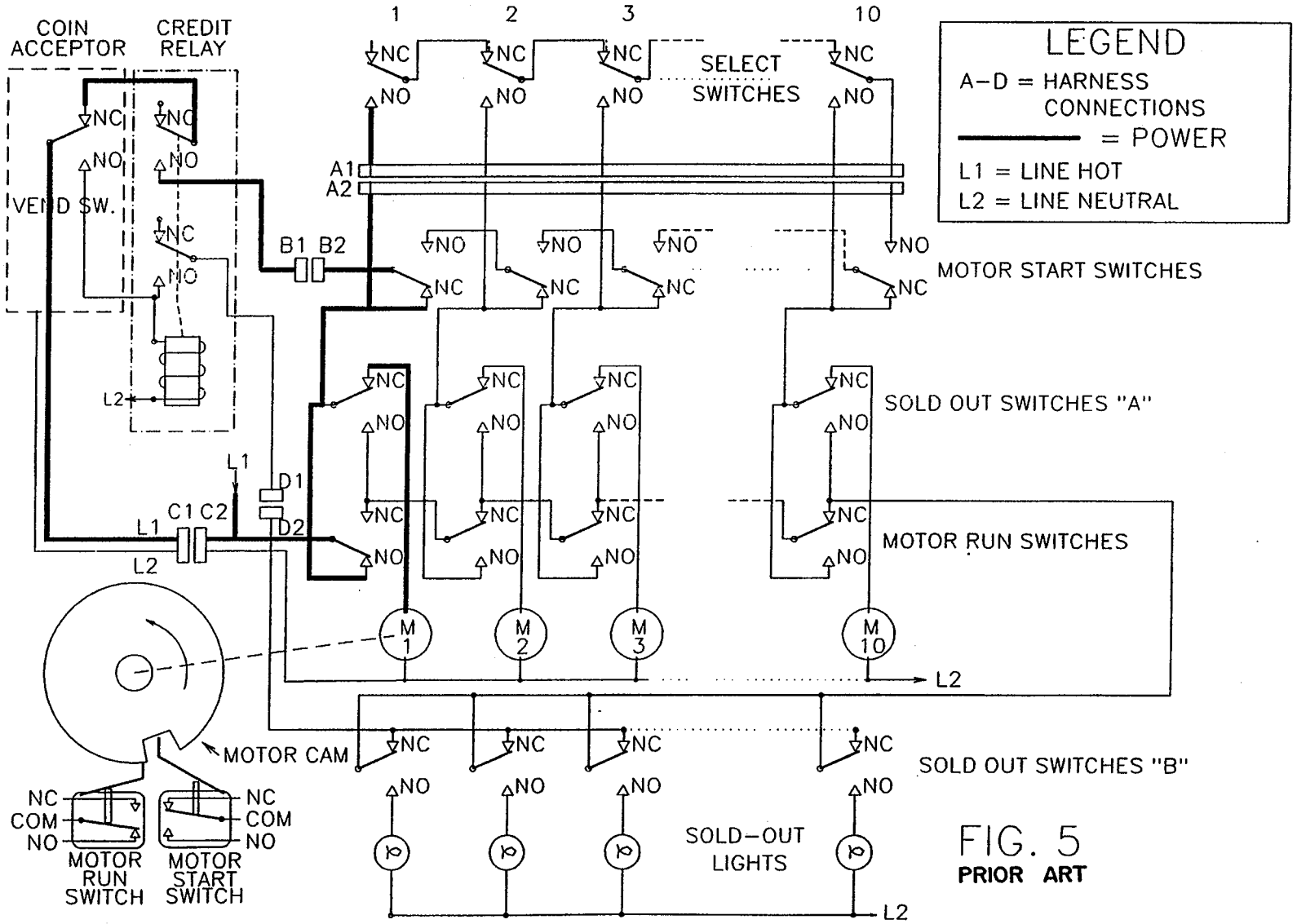
FIG. 5 PRIOR ART
Figure 6:
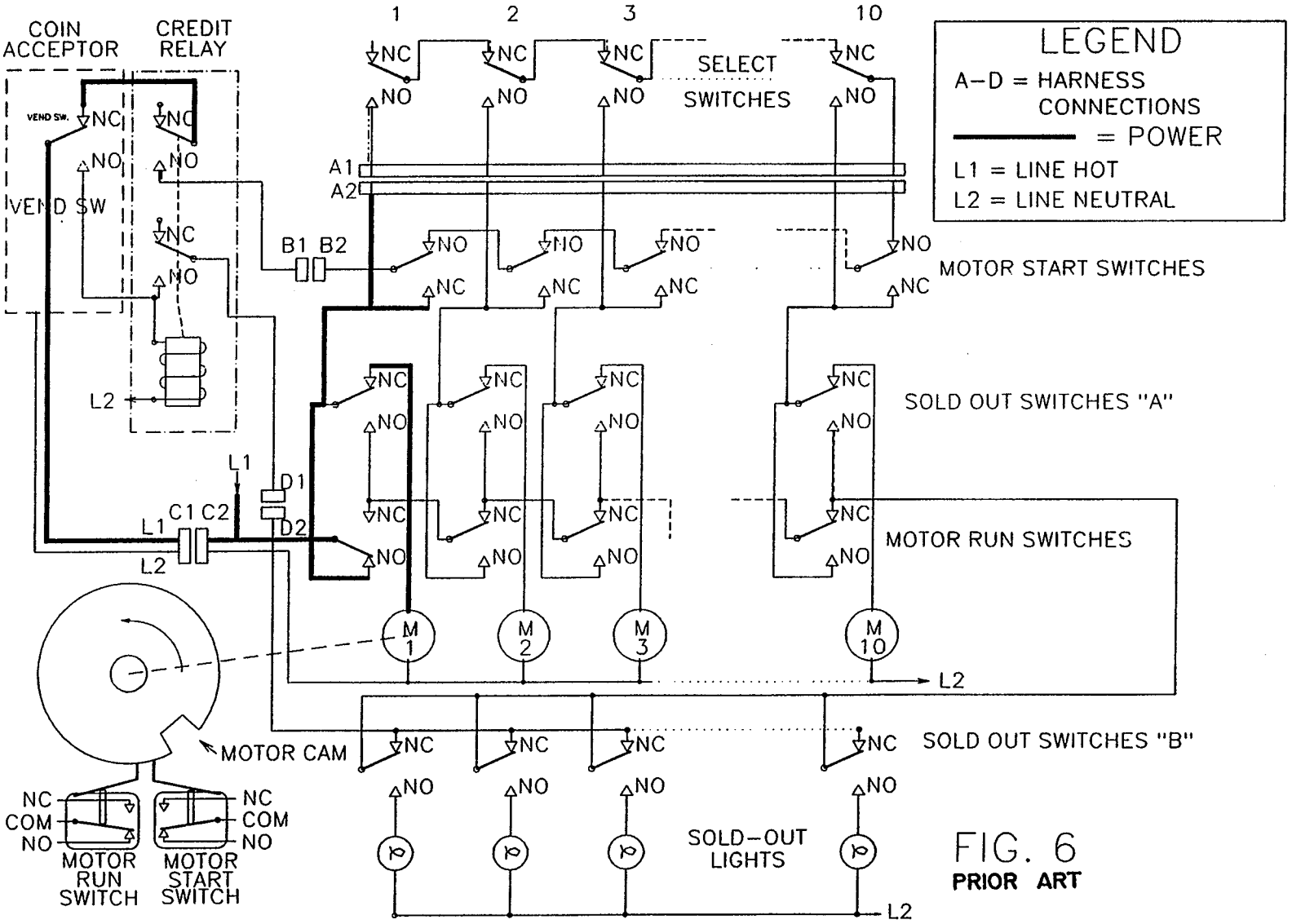
FIG. 6 PRIOR ART

In FIG. 3, it is assumed that the number 1 selector switch has been activated by a purchaser the customer depressing selector button number 1, which is, of course, accessible on the front of the vending machine. Consequently, in FIG. 3, it is seen that the select switch for column number 1 has been moved from the open position to the closed position. Consequently, power is now applied to the motor M1 through "sold out switch" number 1 and the motor begins to run, causing the corresponding shaft to turn. As the shaft turns, the motor start switch lever drops into a cam groove and the switch is turned off, switching the power from the credit relay to the motor, as shown in FIG. 4. As the cam continues to rotate, the motor run switch lever is pushed out of the cam groove and the switch is turned on as shown in FIG. 5. The motor run switch now provides the power to the motor. At the same time, power is removed from all subsequent motor run switches, "sold out switches" and the credit relay which now opens, as shown in FIG. 5. As the cam continues to rotate, the motor start switch closes, as shown in FIG. 6. Because the motor run switch is the only one energizing the motor, the rotation of the shaft continues until the motor run switch lever drops into the cam groove to open this switch, thus completing the cycle and returning the vending machine to the idle condition corresponding to FIG. 1.

Figure 7:
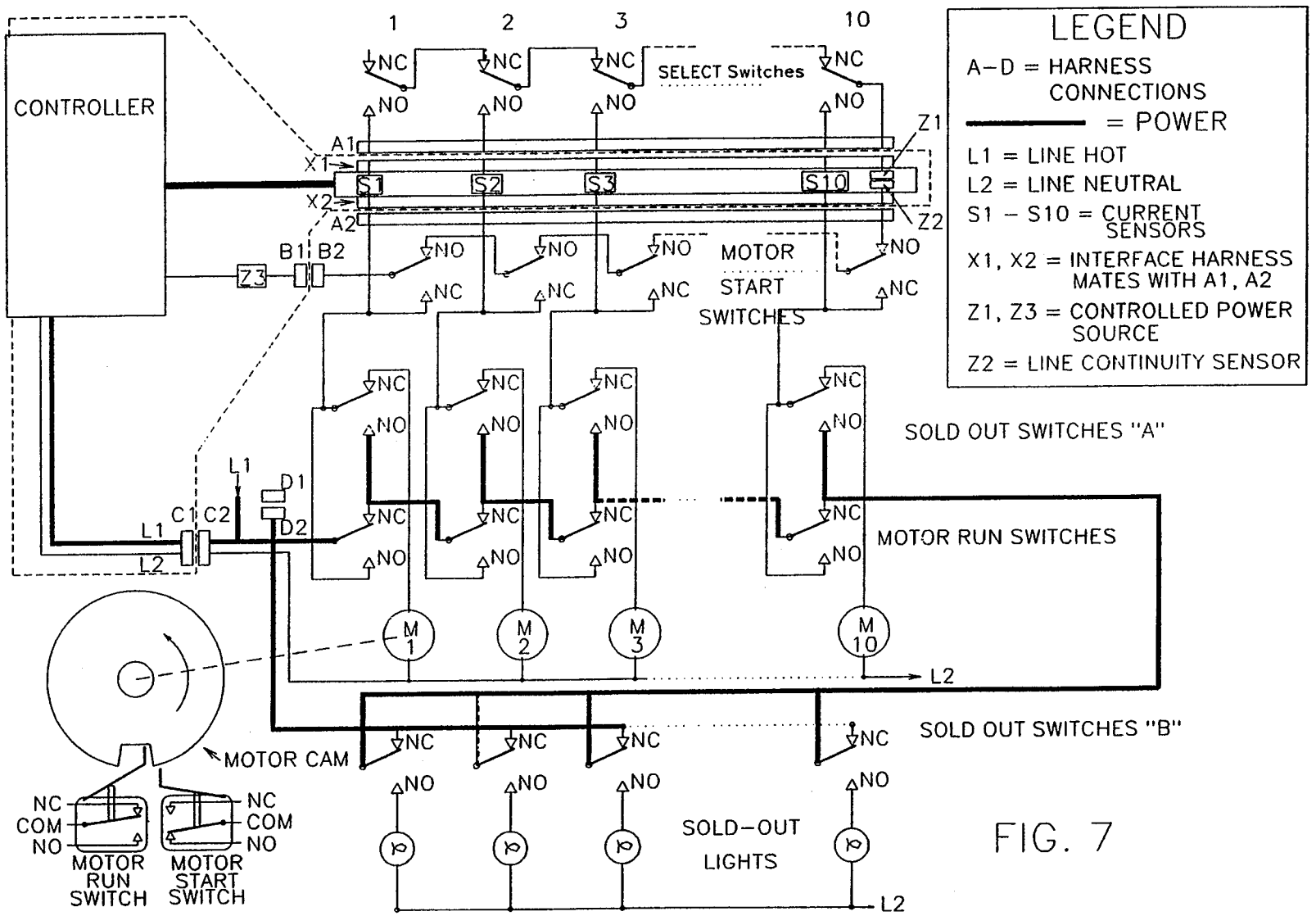
FIG. 7 is a schematic diagram similar to that of FIGS. 1 through 6, but illustrating the modifications made to the electromechanical machine by way of the present invention.

It was the intention in designing the apparatus of the present invention to provide as many of the fully electronic vender features as possible in a controller that would be installed in an electromechanically controlled vending machine, while requiring minimal or no changes to the harnesses in the existing vending machine. FIG. 7 illustrates this apparatus installed in the vending machine of FIGS. 1 through 6. FIG. 7 illustrates that the harness connector A comprising connectors A1 and A2, has been disconnected and an interface harness connected therebetween by means of connectors X1 and X2. The power lines from the selector switches are shown passing through a plurality of modules labelled S1 through S10. In addition, the last motor start switch to the right in FIG. 7 and the last select switch to the right in FIG. 7 are connected to separate modules identified as Z2 and Z1, respectively. Another module labelled Z3 is shown connected to the first or left most motor start switch in FIG. 7. In actuality, all of the S and Z modules shown in FIG. 7 are physically located on a circuit board on which the controller is mounted, but are shown in FIG. 7 in the circuit position they occupy to more clearly indicate their function.

Figure 8:
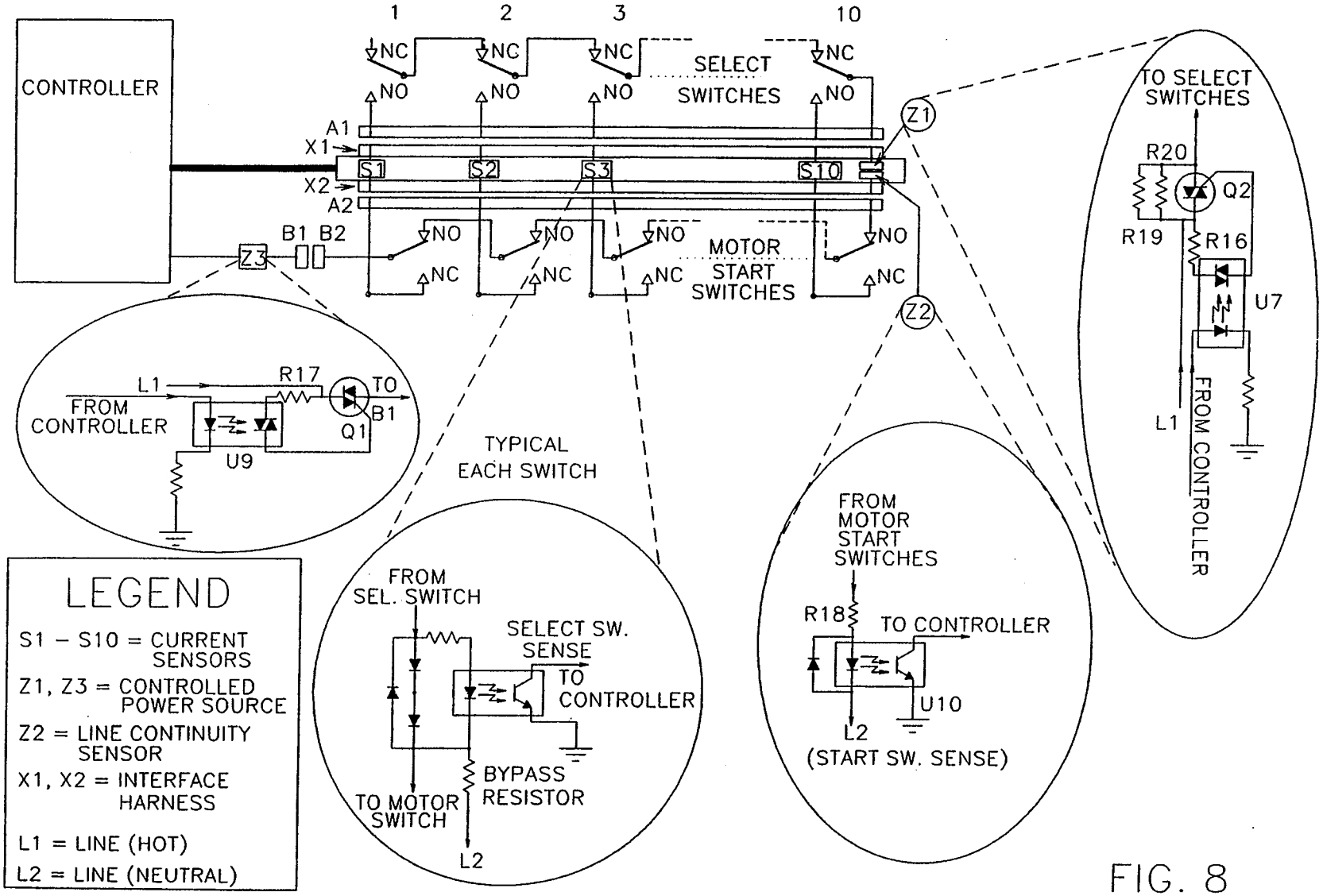
FIG. 8 is an expanded version of FIG. 7 illustrating the sensing and power source circuits used therein.

The individual schematic circuits comprising the S and Z modules are shown in FIG. 8. In order to sense selector switch closures, S modules are used on each select line. As shown in FIG. 8, each S module, that is S1 through S10, comprises three diodes, an opto-coupler and a bypass resistor. Two of the three diodes are connected in series for current flow through the motor's sold out switch. The third diode is connected in parallel with the two series connected diodes. Also connected in parallel with the two series connected diodes, is an opto-coupler such as a model number 4N35B opto-coupler, manufactured by Texas Instruments. As seen in FIG. 8, the input portion of the opto-coupler comprises a light emitting diode (LED) which is in series with a 27 Ohm current limiting resistor. The LED is, in turn, connected to a 15K Ohm bypass resistor, the latter being connected to the point L2 (Line Neutral) shown in FIG. 7, which effectively connects the bypass resistor in parallel with the motor and its associated "sold out" switch. Thus, the S module on each select line provides a path for the alternating current through diodes. When current flows, the voltage drop across the two series diodes is sufficient to turn on the opto-coupler, thereby generating a switch/sense signal for turning on the light activated transistor switch in the opto-coupler. In order to insure a current path, even if the motor is disconnected, such as when it is in a "sold out" condition, the S module bypass resistor is connected across the motor to assure such a current path. However the resistance is sufficiently large (e.g., 15K Ohms), so that when the motor is connected, the resistor does not reduce the motor drive current to any significant degree.

As in fully electronic vending machines, pressing a select switch without depositing money into the machine, will make the price of that selection appear on the display. Therefore, power has to be on the select switches at all times for the S module sensors to turn on, but the power should be limited so that the motors don't start to run. This function is accomplished by controlled power source module Z1. As seen in FIG. 8, module Z1 comprises a triac Q2, connected in parallel with two current limiting resistors R19 and R20, which are each 39K Ohm resistors. The triac Q2 is connected through a 180 Ohm resistor R16 to an triac optical coupler, U7, such as a model number MOC3043 opto-coupler, manufactured by Motorola, Inc. The diode input to the triac opto-coupler U7 is connected to the controller and is used to apply 110 Volts AC to the triac Q2, thereby applying power to the select switch by means of a low voltage logic level power source from the microcontroller. The triac Q2, acting as a 110 Volt AC switch, connects the select switch to the hot line L1 bypassing resistors R19 and R20. With triac Q2 open, the resistors R19 and R20 in combination with the series impedence of the motor, or with the bypass resistor in the corresponding S module, permit only enough current to flow through the sense module to sense the depression of the select switch. When a purchaser enters coins in the vending machine and presses a selection button, and the controller determines that a vend is allowed from the selected button, full power is applied to the select switches by turning triac Q2 on in module Z1, thus bypassing the current limiting resistors R19 and R20 and thereby permitting sufficient current to flow through the corresponding motor to activate it.

Once the vend function is started, the controller must be able to sense whether the motor is moving or not. To accomplish this, controlled power source module Z3 and line continuity sensor module Z2 are used. As soon as full power is applied to the select switches, triac Q1 in module Z3 is turned on to apply power to the motor start switches. As seen in FIG. 8, module Z3 comprises an opto-coupler U9, the input of which is an LED connected to ground through a 820 Ohm current limiting resistor. The output of the opto-coupler U9 is connected through a 180 Ohm current limiting resistor to the triac Q1. The triac Q1 is connected to the connector B1 shown in FIG. 7, which is in turn connected through mating connector B2 to the motor start switches. When full power is applied to the select switches, Q1 in module Z3 is turned on to apply power to the motor start switches. This power is detected by module Z2. Module Z2, as shown in FIG. 8, comprises an opto-coupler U10, the input to which (from the motor start switches) is connected in series with a 58K Ohm resistor R18 and in parallel with an oppositely connected diode. The output of the opto-coupler U10 is connected to the controller, thereby providing sensing of the start switch for detecting power application to the motor. If the motor runs, the motor start switch turns off, as previously described in conjunction with FIG. 4, thereby breaking the circuit and turning module Z2 off. If module Z2 does not turn off after a period of time, the controller effectively "learns" that the motor is not running and notifies the purchaser that it will be necessary to choose another selection or press a refund button.

Figure 9:
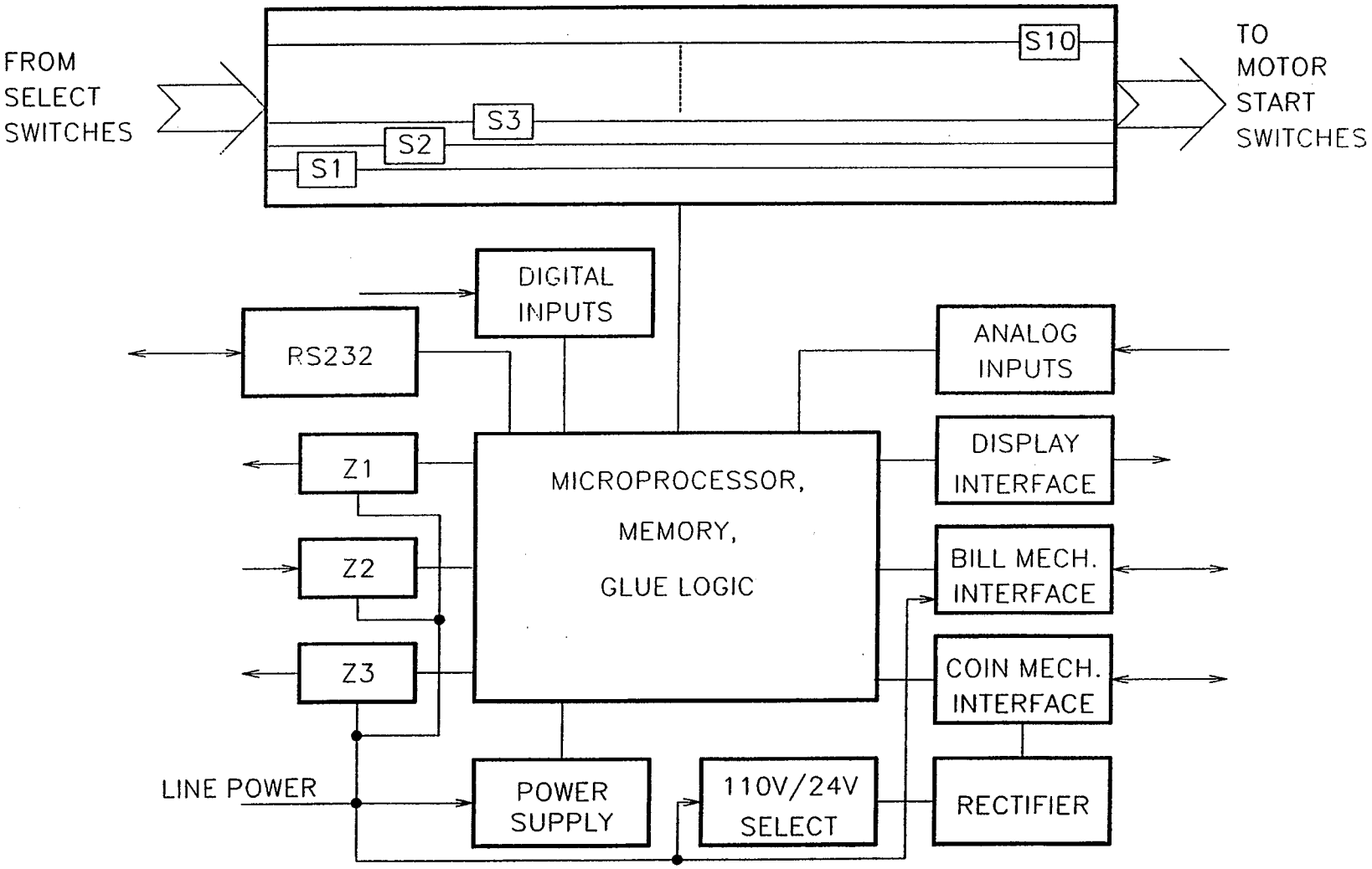
FIG. 9 is a block diagram of the present invention illustrating the various interconnections to the microcontroller of the present invention.

The apparatus of the present invention is shown in block diagram form in FIG. 9. As seen in that figure, in addition to the S modules and Z modules previously described in conjunction with FIG. 8, the apparatus comprises a microprocessor and associated memory and glue logic comprising buffers, multiplexers, de-multiplexers, flip-flops, and the like, that are normally used to interface the microprocessor for input and output signal transfer. Furthermore, as seen in FIG. 9, the apparatus of the present invention comprises an RS232 interface which provides a number of communications options, such as a DEX interface wire or infrared link and/or a computer modem telephone link to permit transfer of accounting and set up information into and out of the vending machine, either locally or remotely. The apparatus of the present invention also comprises a digital input interface, which permits the apparatus to respond to switch closures for switches such as door switches, tilt switches, mode switches and the like, such as for switching between normal operating mode and an accounting retrieval mode or the like.

The apparatus of the present invention also preferably includes an analog input interface, which by way of example may be used to connect the microprocessor to a temperature monitor, such as for controlling the temperature range of the refrigeration unit within the vending machine. Also included in the apparatus of the present invention is a display interface which may be used to connect to a four digit or eight character display device or other kinds of displays and includes the capability to automatically recognize which of those two options is, in fact, being used. There is in addition in the apparatus of the present invention, interface capability for a bill mechanism for receiving paper currency and for a coin mechanism for receiving coin currency. Typical coin mechanisms used in the vending machine industry are powered by an unfiltered, rectified DC voltage at either 110 Volts or 24 Volts. Accordingly, the present invention also provides the ability to provide a manual selection of those two optional voltages, depending upon the coin mechanism being used and to provide a rectifier to output the aforementioned rectified unfiltered DC voltage. The power supply used in the present invention, shown in FIG. 9, receives 110 Volt AC line power and converts it to a 5 Volt DC power for the various logic circuits, including the microprocessor, memory, logic and the like.

It will now be understood that what has been disclosed herein comprises a method and apparatus for carrying out the conversion of purely electromechanical can and bottle vending machines to microprocessor controlled can and bottle vending machines. The present invention provides a method and apparatus for carrying out such a conversion at the site of the vending machine in a relatively short amount of time, without requiring any special tools and without requiring any changes to the existing wire harness of the electromechanical machine. The principal advantage of the invention is for converting electromechanical single price vending machines to microprocessor controlled multi-price vending operation and more importantly carrying out such a conversion without requiring re-wiring of the wire harness associated with the switch and motor operation of the existing electromechanical machine. The method of the present invention comprises the steps of removing the "smart coin" acceptor, removing or disconnecting the credit relay from the existing vending machine and installing a "dumb coin" acceptor and microcontroller in their place, then disconnecting the harness connectors which normally provide connection between the motor select switches and the motor start switches, as well as the connections between the motor start switches and the credit relay and between the "sold out" switches and the credit relay and interposing a series of sensing modules therebetween, each of which is connected to a microprocessor controller. A "smart coin selector" comprises all of the typical mechanical logic to "approve" a coin deposit before activating the credit relay. A "dumb coin acceptor" relies on other means (the controller) to "approve" a coin deposit. The sensing circuits provide circuit compatability between 110 Volt AC motor circuits and low voltage DC logic circuits, without requiring re-wiring in the existing motor and switch harness. The present invention further comprises means for generating a low current motor sensing capability which relies on current that is too low to operate the motor normally used for dispensing the cans and bottles, but is of sufficient magnitude to sense switch closures in the motor circuit. In addition, the present invention uses bypass resistors in parallel with each motor to permit sensing of switch selection, even when a motor is disconnected, such as when there is a corresponding "sold out" condition.

Those having skill in the art to which the present invention pertains, will now as a result of the applicants' teaching herein, perceive various modifications and additions which may be made to the invention. By way of example, the use of opto-couplers and other specific circuit components disclosed herein for accomplishing the conversion from purely electromechanical vending machines, to microprocessor-controlled vending machines, may be substituted by other components while still achieving the advantageous features of the present invention. Accordingly, all such modifications and additions which may be made to the present invention and still permit such a conversion without re-wiring the motor and switch harness, are deemed to be within the scope of the claims appended hereto and their equivalents.

We claim:

1. A multiple price vending machine of the type having an externally accessible plurality of select switches for choosing at least one of a plurality of different products to be vended in response to the deposit of currency, a plurality of AC motor-operated cam switches including at least a motor start switch and a motor run switch for each such different product, the apparatus comprising:

an electronic controller and a price-independent coin acceptor;

a plurality of select switch closure sensors, at least one such closure sensor electrically connected between each of said select switches and each of said motor start switches for sensing current flow therebetween and for transmitting a corresponding select switch sense signal to said controller;

a first power control device electrically connected between line power and said motor start switches for selectively applying line power to said motor start switches in response to said controller; and a second power control device electrically connected between line power and said select switches for selectively applying line power to said select switches in response to said controller.

2. The apparatus recited in claim 1 wherein each of said closure sensors and each said first and second power control devices comprises an optical coupler for electrically isolating AC motor voltage from DC controller voltage.

3. The apparatus recited in claim 1 wherein each of said closure sensors comprises a bypass resistor connected to bypass a corresponding AC motor for sensing select switch closures even when said AC motor is switched into a non-running condition after all corresponding products have been vended.

4. The apparatus recited in claim 1 wherein each of said first and second power control devices comprises an AC switch and means for coupling said AC switch to said controller for selective closing of said AC switch by said controller.

5. The apparatus recited in claim 4 wherein said second power control device further comprises at least one current limiting resistor electrically connected in parallel with said AC switch for permitting a reduced current to flow through a depressed select switch to permit closure sensing by a closure sensor without activating a corresponding AC motor.

6. The apparatus recited in claim 1 further comprising a line continuity sensor electrically connected between said motor start switches and line neutral and having a coupling means connected to said controller for sensing current turn off through a motor start switch and transmitting a signal indicating such current turn off to the controller.

7. A multiple price vending machine of the type having an externally accessible plurality of select switches for choosing at least one of a plurality of different products to be vended in response to the deposit of currency, a plurality of AC motor-operated cam switches including at least a motor start switch and a motor run switch for each such different product, the apparatus comprising:

an electronic controller and a price-independent coin acceptor;

a plurality of select switch activation sensors, at least one such sensor electrically connected to each such select switch for sensing activation thereof and for transmitting a corresponding select switch sense signal to said controller;

a first power control device electrically connected between line power and said motor start switches for selectively applying line power to said motor start switches in response to said controller; and at least one second power control device electrically connected between line power and at least one of said select switches for selectively applying line power to said at least one select switch in response to said controller.

8. In a single price vending machine of the type having an externally accessible plurality of select switches for choosing at least one of a plurality of different products to be vended in response to the deposit of currency, a plurality of AC motor-operated cam switches including at least a motor start switch and a motor run switch for each such different product, a single price coin acceptor and a credit relay; a method for converting the vending machine from single price to multiple price operation; the method comprising the steps of:

a) replacing said credit relay and single price coin acceptor with an electronic controller and a price-independent coin acceptor;

b) connecting a switch closure sensor between each of said select switches and each of said motor start switches for sensing current flow therebetween;

c) transmitting a select switch sense signal to said controller from said sensor when said current flow is sensed;

d) connecting a first power control device between said motor start switches and AC line power;

e) selectively applying line power to said motor start switches by coupling said controller to said first power control device;

f) connecting a second power control device between said select switches and AC line power; and g) selectively applying line power to said select switches by coupling said controller to said second power control device.

9. The method recited in claim 8 wherein steps b), d) and f) comprise the additional step of disconnecting existing connectors in said single price vending machine and then reconnecting said existing connectors to said sensors, first control device and second control device without splicing wires.

10. The method recited in claim 8 further comprising the steps of:

h) connecting a line continuity sensor between said motor start switches and line neutral;

i) coupling said line continuity sensor to said controller; and j) transmitting a signal from said line continuity sensor to said controller to indicate current turn off through a motor start switch.

11. The method recited in claim 8 further comprising the steps of:

h) applying line power to said select switches at all times through a current limitor whereby select switch sensing is available even before currency is deposited in said price-independent coin acceptor, but without activating an AC motor.

12. In a single price vending machine of the type having an externally accessible plurality of select switches for choosing at least one of a plurality of different products to be vended in response to the deposit of currency, a plurality of AC motor-operated cam switches including at least a motor start switch and a motor run switch for each such different product, a single price coin acceptor and a credit relay; a method for converting the vending machine from single price to multiple price operation; the method comprising the steps of:

a) replacing said credit relay and single price coin acceptor with an electronic controller and a price-independent coin acceptor;

b) connecting at least one switch activation sensor to each of said select switches for sensing respective activation thereof;

c) transmitting a select switch sense signal to said controller from said sensor when said activation is sensed;

d) connecting a first power control device between said motor start switches and AC line power;

e) selectively applying line power to said motor start switches by coupling said controller to said first power control device;

f) connecting at least one second power control device between at least one of said select switches and AC line power; and g) selectively applying line power to said at least one of said select switches by coupling said controller to said at least one second power control device.

* * * * *